US009445675B1

(12) United States Patent
DeSena et al.

(10) Patent No.: US 9,445,675 B1
(45) Date of Patent: Sep. 20, 2016

(54) MODULAR DISPLAY AND DISPENSING APPARATUS AND METHOD

(71) Applicant: Henschel-Steinau, Inc., Allendale, NJ (US)

(72) Inventors: Michael D. DeSena, West Caldwell, NJ (US); Michael D. Luberto, River Vale, NJ (US); Getachew Kassa, West Orange, NJ (US)

(73) Assignee: Henschel-Steinau, Inc., Allendale, NJ (US)

( * ) Notice: Subject to any disclaimer, the term of this patent is extended or adjusted under 35 U.S.C. 154(b) by 0 days.

(21) Appl. No.: 14/593,019

(22) Filed: Jan. 9, 2015

(51) Int. Cl.
*A47F 1/12* (2006.01)

(52) U.S. Cl.
CPC *A47F 1/126* (2013.01); *A47F 1/12* (2013.01)

(58) Field of Classification Search
CPC ..... A47F 1/12; A47F 1/125; A47F 1/126
See application file for complete search history.

(56) References Cited

U.S. PATENT DOCUMENTS 1,702,987 A * 2/1929 Wilson ..... A47F 1/125 211/126.1
2,098,844 A * 11/1937 Waxgiser ..... A47B 81/007 211/59.3
2,980,259 A * 4/1961 Fowlds ..... A47F 1/10 211/59.3
5,366,099 A * 11/1994 Schmid ..... A47F 1/126 211/175
5,413,229 A 5/1995 Zuberbuhler et al.
5,458,248 A * 10/1995 Alain ..... A47B 45/00 211/153
5,469,976 A 11/1995 Burchell
5,613,621 A * 3/1997 Gervasi ..... A47F 1/125 221/279
6,155,438 A 12/2000 Close
6,227,386 B1 5/2001 Close
6,357,606 B1 * 3/2002 Henry ..... A47F 1/126 211/184
6,719,151 B2 * 4/2004 Close ..... A47F 1/12 211/119.003
6,923,330 B1 8/2005 Nagel
7,124,898 B2 10/2006 Richter et al.
7,168,579 B2 * 1/2007 Richter ..... A47F 1/126 211/59.3
7,458,473 B1 * 12/2008 Mason ..... A47F 1/126 211/175
7,631,771 B2 12/2009 Nagel et al.
7,703,614 B2 * 4/2010 Schneider ..... A47F 3/14 211/184
8,066,128 B2 11/2011 Crawbuck et al.
8,113,360 B2 2/2012 Olson
8,186,520 B2 * 5/2012 Schneider ..... A47F 1/126 211/184
8,627,965 B2 * 1/2014 Hardy ..... A47F 1/126 211/184
8,851,303 B2 * 10/2014 Crawbuck ..... A47F 1/12 211/59.2
9,138,076 B2 * 9/2015 Hardy ..... A47F 1/126

(Continued)

FOREIGN PATENT DOCUMENTS

FR 2851441 A1 * 8/2004 ..... A47F 1/125

*Primary Examiner* — Stanton L Krycinski
(74) *Attorney, Agent, or Firm* — Arthur Jacob

(57) ABSTRACT

A modular apparatus is erected from a kit of component parts to provide for displaying and dispensing selected merchandise at a point-of-purchase placed at a selected site. The merchandise is in the form of packages of selected dimensions to be arranged serially along the apparatus. The kit facilitates transport to the site and erection of the apparatus on-site to accommodate the packages of selected width. Adjustment of the apparatus to the dimensions of the packages is accomplished during erection of the apparatus at the selected site by movement of wall members of the apparatus into guiding juxtaposition with the packages. Rack and pawl arrangements integral with the wall members enable ease of assembly while attaining and maintaining accurate on-site adjustment.

21 Claims, 6 Drawing Sheets

(56) References Cited

U.S. PATENT DOCUMENTS

2003/0217980 A1* 11/2003 Johnson ..... A47F 1/126
211/59.3
2004/0178158 A1* 9/2004 Close ..... A47F 1/12
211/59.3
2005/0098515 A1* 5/2005 Close ..... A47F 1/12
211/59.3
2007/0068885 A1* 3/2007 Busto ..... A47F 1/125
211/59.3
2007/0158281 A1* 7/2007 Hardy ..... A47F 1/126
211/59.3
2008/0156751 A1 7/2008 Richter et al.
2009/0101606 A1* 4/2009 Olson ..... A47F 1/125
211/59.3
2010/0096345 A1* 4/2010 Crawbuck ..... A47F 1/125
211/59.3

* cited by examiner

MODULAR DISPLAY AND DISPENSING APPARATUS AND METHOD

The present invention relates generally to point-of-purchase display and dispensing of merchandise and pertains, more specifically, to apparatus for enabling the display and ready dispensing of serially arranged merchandise packages at a point-of-purchase site, while facilitating transport to the site and erection of the apparatus at the site for the accommodation of merchandise packages of different dimensions.

An ever-increasing variety of packaged merchandise offered for sale at sites where points-of-purchase are located along store shelves has led to a requirement for better organization of such merchandise, along with increased ease of selection and dispensing, together with a simplified accommodation of items of any selected one of a range of different dimensions. Display and dispensing trays have become staples in assisting the organizing, display and dispensing of such items.

The present invention provides an apparatus for displaying and dispensing merchandise at a point-of-purchase and for facilitating the accommodation of such items at the point-of-purchase location. As such, the present invention attains several objects and advantages, some of which are summarized as follows: Provides an apparatus which facilitates the display and dispensing of serially arranged merchandise packages at a point-of-purchase, together with ease of erection, installation and selective adjustment to accommodate merchandise packages of any one of a range of different dimensions; enables increased economy and versatility in accommodating the transport of apparatus for dispensing of merchandise at a point-of-purchase site while allowing simplified adjustments during erection of the apparatus at the point-of-purchase site to accommodate the particular dimensions of the merchandise to be dispensed; facilitates the organization of merchandise for display and dispensing at points-of-purchase located along store shelves; provides simplified apparatus constructed economically of fewer component parts; allows compact packaging for economical transport to a selected site and subsequent ease of set-up and use at the site for accommodating a wide variety of merchandise displayed and dispensed at a point-of-purchase; offers less obtrusive and aesthetically more desirable apparatus for the display and dispensing of merchandise packages; affords purchasers with added ease and convenience in selecting merchandise presented at a point-of-purchase; provides a less complex apparatus for the display and dispensing of merchandise at a point-of-purchase, capable of exemplary performance over a relatively long service life.

The above objects and advantages, as well as further objects and advantages, are attained by the present invention which may be described briefly as a modular apparatus for displaying and dispensing selected merchandise at a point-of-purchase location placed at a selected site adjacent a display shelf extending in lateral directions at the site, the merchandise being in the form of packages of selected dimensions, including a selected lateral width, arranged serially along a path of travel extending longitudinally toward a forward dispensing location placed at the point-of-purchase, the apparatus facilitating transport to and erection at the site to accommodate the packages of selected dimensions, the apparatus comprising: a track member having a platform for extending along a longitudinal direction adjacent the path of travel, in juxtaposition with the serially arranged packages, the platform including a near end for placement adjacent the forward dispensing location, a far end spaced longitudinally away from the near end, and laterally opposite sides; a pusher configured for sliding engagement with the track member, the pusher being selectively movable along the track member in longitudinal directions between the far end and the near end of the track member; a plurality of slots extending laterally within the track member, altitudinally below the platform and spaced longitudinally from one another along the track member; a pair of wall members, each wall member having a longitudinal length and extending altitudinally between an upper edge and a lower edge, each wall member having a plurality of tenons projecting laterally from the wall member, adjacent the lower edge of the wall member, and spaced longitudinally from one another along the wall member such that the plurality of tenons will register with a counterpart plurality of slots, each tenon having altitudinal and lateral dimensions complementary to corresponding altitudinal and lateral dimensions of a counterpart slot so that upon registration of each tenon with a counterpart slot, each tenon will extend into engagement with a counterpart slot; a rack extending in a lateral direction along either one of the counterpart slots and tenons, each rack having plurality of teeth spaced apart laterally along the rack; and a pawl arrangement projecting in an altitudinal direction from a corresponding one of the slots and the tenons in position to engage a counterpart rack upon insertion of each tenon into a corresponding counterpart slot; such that upon placement of packages of selected dimensions upon the platform, alignment of each one of the pair of wall members with a corresponding one of the laterally opposite sides of the track member and insertion of each tenon projecting from each wall member within a counterpart slot in the track member, movement of the wall members laterally toward one another will engage each pawl arrangement with a corresponding rack, allowing such movement of the wall members toward one another until the wall members are placed in juxtaposition with the selected lateral width of the packages on the platform, whereupon the engagement of each pawl arrangement with adjacent corresponding teeth of a counterpart rack will secure the wall members in place, in guiding juxtaposition with the serially arranged packages on the platform.

In addition, the present invention provides a method for erecting a modular apparatus for displaying and dispensing selected merchandise at a point-of-purchase location placed at a selected site adjacent a display shelf extending in lateral directions at the site, the merchandise being in the form of packages of selected dimensions, including a selected lateral width, arranged serially along a path of travel extending longitudinally toward a forward dispensing location placed at the point-of-purchase, the apparatus facilitating transport to and erection at the site to accommodate the packages of selected dimensions, the method comprising: placing at the site, a track member having a platform for extending along a longitudinal direction adjacent the path of travel, in juxtaposition with the serially arranged packages, the platform including a near end for placement adjacent the forward dispensing location, a far end spaced longitudinally away from the near end, and laterally opposite sides; engaging a pusher with the track member, the pusher being configured for sliding engagement with the track member, selectively movable along the track member in longitudinal directions between the far end and the near end of the track member; providing a plurality of slots extending laterally within the track member, altitudinally below the platform and spaced longitudinally from one another along the track member; providing a pair of wall members, each wall member having a longitudinal length and extending altitudinally between an upper edge and a lower edge, each wall member having a plurality of tenons projecting laterally from the wall member, adjacent the lower edge of the wall member, and spaced longitudinally from one another along the wall member; registering the plurality of tenons with a counterpart plurality of slots, each tenon being provided with altitudinal and lateral dimensions complementary to corresponding altitudinal and lateral dimensions of a counterpart slot so that upon registration of each tenon with a counterpart slot, each tenon will extend into engagement with a counterpart slot; providing a rack extending in a lateral direction along either one of the counterpart slots and tenons, each rack having plurality of teeth spaced apart laterally along the rack; and providing a pawl arrangement projecting in an altitudinal direction from a corresponding one of the slots and the tenons in position to engage a counterpart rack upon insertion of each tenon into a corresponding counterpart slot; placing packages of selected dimensions upon the platform; aligning each one of the pair of wall members with a corresponding one of the laterally opposite sides of the track member and inserting each tenon projecting from each wall member into a counterpart slot in the track member; moving the wall members laterally toward one another to engage each pawl arrangement with a corresponding rack; and continuing such movement of the wall members toward one another until the wall members are placed in juxtaposition with the selected lateral width of the packages on the platform, whereupon the engagement of each pawl arrangement with adjacent corresponding teeth of a counterpart rack will secure the wall members in place, in guiding juxtaposition with the serially arranged packages on the platform, to complete the erection of the apparatus.

Further, the present invention includes a kit of component parts for erecting a modular apparatus at a selected site for displaying and dispensing selected merchandise at a point-of-purchase location placed at the selected site adjacent a display shelf extending in lateral directions at the site, the merchandise being in the form of packages of selected dimensions, including a selected lateral width, to be arranged serially along a path of travel extending longitudinally toward a forward dispensing location placed at the point-of-purchase, the kit facilitating transport to and erection at the site to accommodate the packages of selected dimensions, the kit comprising: a track member having a platform extending along a longitudinal direction to be aligned with the path of travel, in juxtaposition with the serially arranged packages, the platform including a near end for placement adjacent the forward dispensing location, a far end spaced longitudinally away from the near end, and laterally opposite sides; a pusher configured for sliding engagement with the track member, to enable the pusher to be selectively movable along the track member in longitudinal directions between the far end and the near end of the track member; a plurality of slots extending laterally within the track member, altitudinally below the platform and spaced longitudinally from one another along the track member; a pair of wall members, each wall member having a longitudinal length and extending altitudinally between an upper edge and a lower edge, each wall member having a plurality of tenons projecting laterally from the wall member, adjacent the lower edge of the wall member, and spaced longitudinally from one another along the wall member for enabling the plurality of tenons to be registered with a counterpart plurality of slots, each tenon having altitudinal and lateral dimensions complementary to corresponding altitudinal and lateral dimensions of a counterpart slot so that upon registration of each tenon with a counterpart slot, each tenon will be able to extend into engagement with a counterpart slot; a rack extending in a lateral direction along either one of the counterpart slots and tenons, each rack having plurality of teeth spaced apart laterally along the rack; and a pawl arrangement projecting in an altitudinal direction from a corresponding one of the slots and the tenons in position to enable engagement with a counterpart rack upon insertion of each tenon into a corresponding counterpart slot; such that upon placement of packages of selected dimensions upon the platform, alignment of each one of the pair of wall members with a corresponding one of the laterally opposite sides of the track member and insertion of each tenon projecting from each wall member within a counterpart slot in the track member, movement of the wall members laterally toward one another will enable engagement of each pawl arrangement with a corresponding rack, allowing such movement of the wall members toward one another until the wall members are placed in juxtaposition with the selected lateral width of the packages on the platform, whereupon the engagement of each pawl arrangement with adjacent corresponding teeth of a counterpart rack will accomplish securement of the wall members in place, in guiding juxtaposition with the serially arranged packages on the platform.

The invention will be understood more fully, while still further objects and advantages will become apparent, in the following detailed description of preferred embodiments of the invention illustrated in the accompanying drawing, in which.

Figure 1:
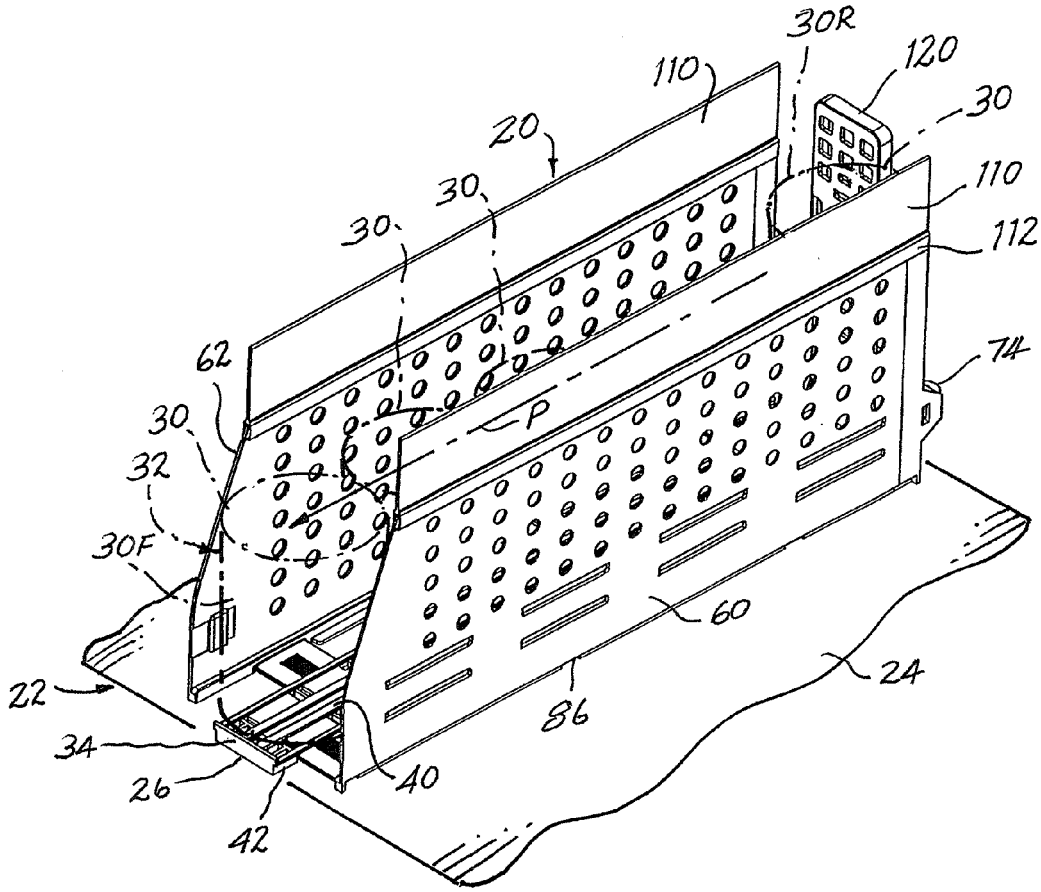
FIG. 1 is a front, top, right side pictorial view of a modular apparatus constructed and erected in accordance with the present invention.

Referring now to the drawing, and especially to FIGS. 1 through 5 thereof, an apparatus constructed in accordance with the present invention is shown at 20 and is seen to be placed at a selected site 22 along a store display shelf 24 for establishing a point-of-purchase 26 where merchandise in the form of packages 30 (illustrated in phantom) are presented to a purchaser (not shown) for selection and sale. Display shelf 24 extends in lateral directions L, and packages 30 are arranged serially along a path of travel P extending longitudinally, in a column 32, toward a forward dispensing location 34 placed at the point-of-purchase 26.

Packages 30 rest upon a platform 40 of a track member 42 and are moved selectively along path of travel P from a far end 44 of the platform 40 toward a near end 46 of the platform 40 by a pusher member 50 configured for sliding engagement with the track member 42. To that end, pusher member 50 includes a carriage 52 having integral runners 54 slidably engaged with counterpart rails 56 extending longitudinally along track member 42, enabling guided longitudinal movement of pusher member 50 along path of travel P, and a paddle 58 extending altitudinally upwardly from the carriage 52 to be placed behind the rearward-most package 30R on the platform 40. Packages 30 are confined for movement along path of travel P by a pair of wall members, shown in the form of laterally opposite side wall members 60 and 62, and pusher member 50 is moved selectively by a pull system 63 having a puller member in the form of a slide 64 mounted upon one of the side wall members, here shown as side wall member 60, within pairs of guides 66 on the one side wall member 60 for selective sliding movement in forward and rearward longitudinal directions along the one side wall member 60.

Movement of the slide 64 is effected manually by a purchaser (not shown) who may grasps a finger-grip 67 provided on the slide 64 at the forward end 68 of the slide 64 to draw the slide 64 forward. An arm 70 extends laterally from adjacent the rearward end 72 of the slide 64, behind the paddle 58 (see FIG. 8), in place to engage the paddle 58 so as to move the paddle 58 forward, longitudinally along path of travel P, and with such forward movement, engage the paddle 58 with the rearward-most package 30R to move the column 32 of packages 30 forward and present a forward-most package 30F at the dispensing location 34. The purchaser then may remove the package 30F and continue shopping or, should the purchaser decide to replace the package 30F, the package 30F merely can be returned to the column 32 with little resistance, since there are no biasing forces present to resist replacement of the selected package 30F within the column 32. In the preferred construction, a coiled constant-force return spring 74 is mounted upon side wall member 60 and is coupled with slide 64 adjacent the rearward end 72 of slide 64 such that slide 64 is biased toward a rearward-most position, as seen in FIG. 8, thereby assuring that the forward end 68 of slide 64, with finger-grip 67, is returned to the retracted position where the slide 64 remains unobtrusive, as in FIG. 1, while awaiting movement by a purchaser for a next selection.

Figure 2:
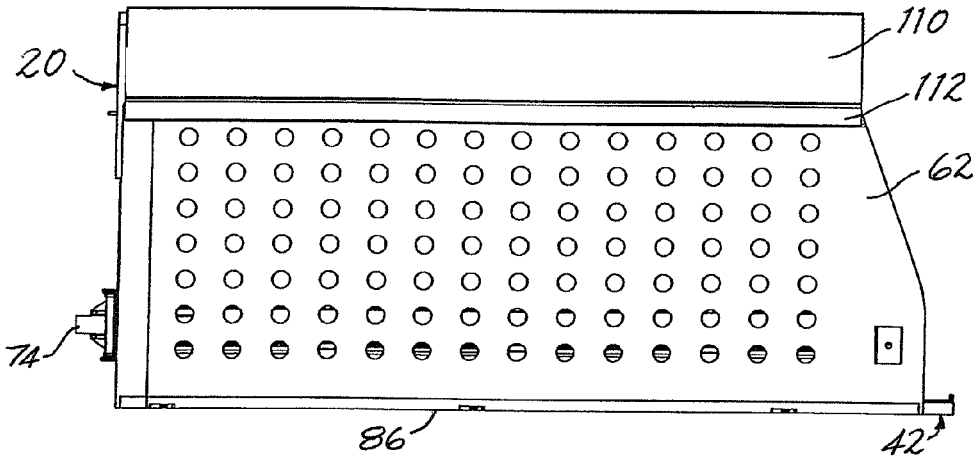
FIG. 2 is a left side elevational view of the apparatus.
Figure 3:
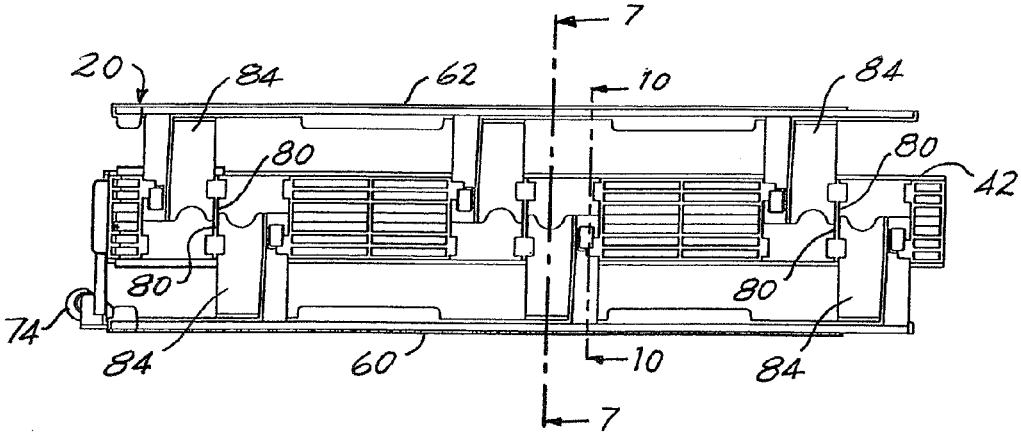
FIG. 3 is a bottom plan view of the apparatus.
Figure 4:
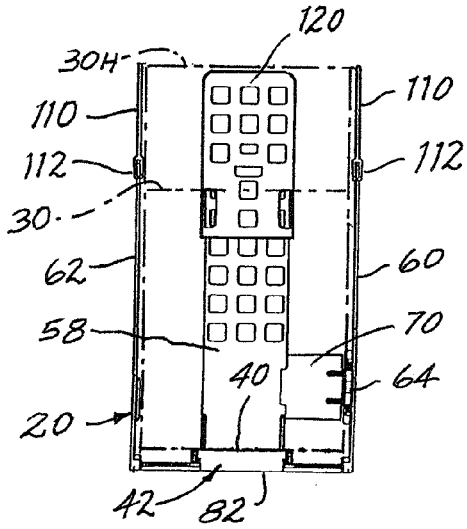
FIG. 4 is a front elevational view of the apparatus.
Figure 7:
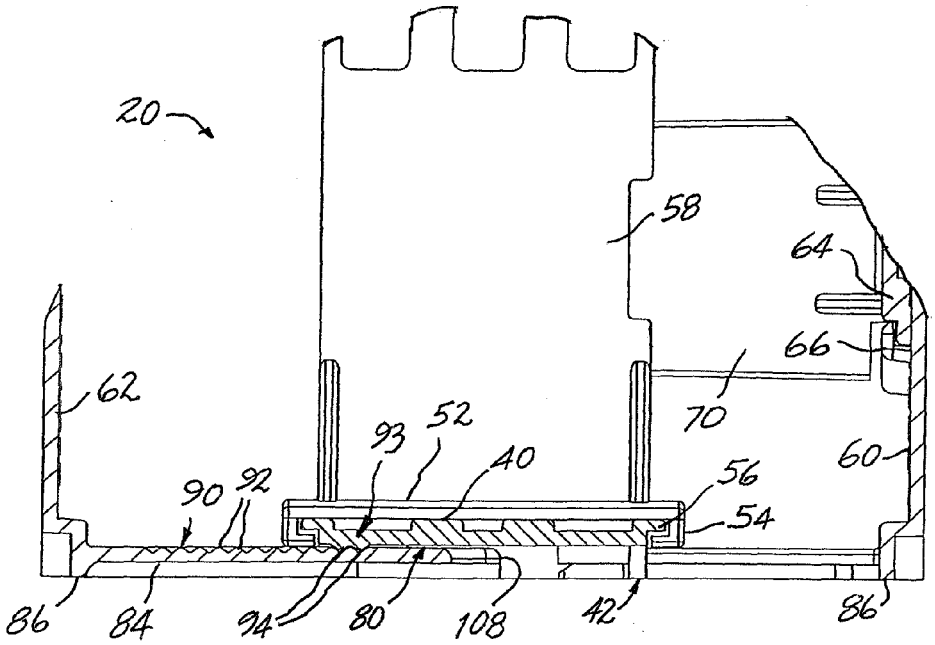
FIG. 7 is an enlarged fragmentary cross-sectional view taken along line 7-7 of FIG. 3.
Figure 8:
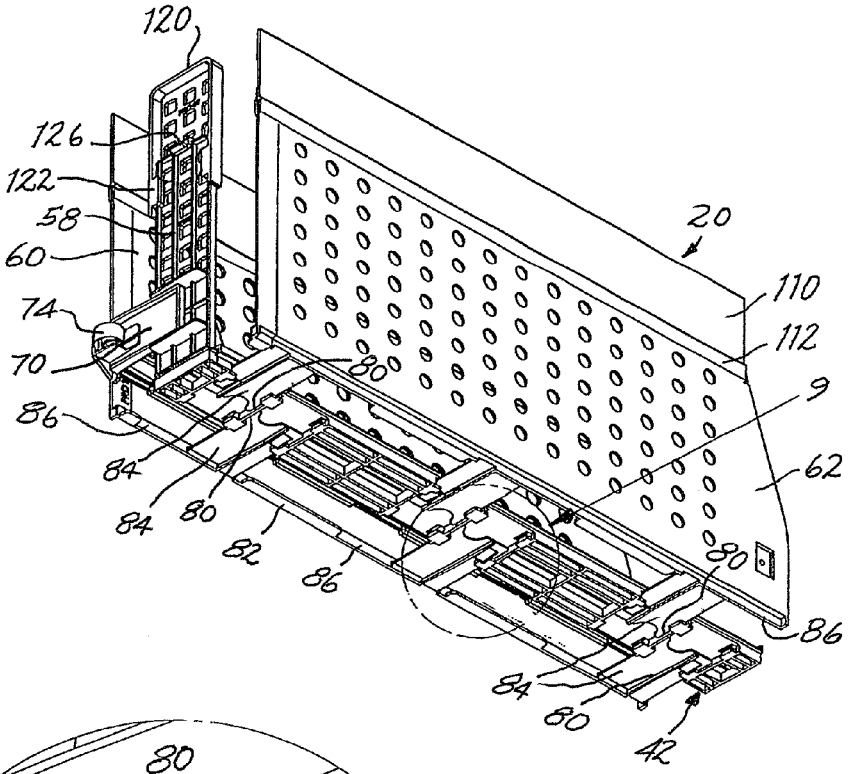
FIG. 8 is a rear, bottom, left side pictorial view of the apparatus.

With reference now to FIGS. 5 through 10, apparatus 20 is provided with a modular construction having component parts configured for convenient and economical packing and shipping in the form of a highly compact kit of unassembled component parts easily assembled while being erected at the selected site 22, and in such manner as to be adjusted readily for accommodating the particular dimensions of the merchandise packages 30 selected for display and dispensing at dispensing location 34. Thus, carriage 52 of pusher member 50 easily is slipped onto track member 42, inserting rails 56 into runners 54 until carriage 52 is fully engaged with track member 42. In a similarly simple manner, slide 64 is inserted through guides 66 for sliding movement in the forward and rearward longitudinal directions along side wall member 60. However, in the preferred construction, wherein return spring 74 is coupled with slide 64, side wall member 60 is shipped with slide 64 already assembled within guides 66 and return spring 74 already mounted upon side wall member 60 coupled with slide 64, as shown in FIGS. 2, 3 and 8.

A plurality of slots 80 extend laterally within track member 42, located altitudinally below platform 40, adjacent basal surface 82 of track member 42, and spaced longitudinally from one another along the track member 42. Each side wall member 60 and 62 includes a plurality of tenons 84 projecting laterally from the corresponding side wall member 60, 62, adjacent lower edge 86 of each side wall member 60, 62, which lower edge 86 is altitudinally opposite an upper edge 88 of each side wall member 60 and 62. Tenons 84 are spaced longitudinally from one another along a corresponding side wall member 60, 62 such that each tenon 84 will register with a counterpart slot 80. Each tenon 84 has altitudinal and lateral dimensions complementary to corresponding altitudinal and lateral dimensions of a counterpart slot 80 so that upon registration of each tenon 84 with a counterpart slot 80, each tenon 84 can be inserted into a counterpart slot 80 for engagement between the tenons 84 and slots 80.

In completing assembly of apparatus 20, at least one package 30, and preferably a column of packages 30, is placed upon platform 40 of track member 42, as illustrated in phantom in FIG. 1. Then, each tenon 84 is inserted into a counterpart slot 80, and side wall members 60 and 62 are moved laterally toward one-another until each side wall member 60 and 62 engages the package 30, or column 32 of packages 30, resting on the platform 40. Each tenon 84 carries a rack 90 extending along the tenon 84 in the lateral direction and having a plurality of teeth 92 oriented in the longitudinal direction and spaced apart laterally along the rack 90. A pawl arrangement 93 includes at least one, and preferably two or more pawls 94 projecting in an altitudinally downward direction into each slot 80 in position to engage a counterpart rack 90. Teeth 92 and pawls 94 are configured for enabling selective movement of each tenon 84 within a counterpart slot 80 and for engagement to secure a selected position of a tenon 84 within a counterpart slot 80. Thus, as best seen in FIG. 7, each tooth 92 has a generally symmetrical saw-tooth-like profile configuration and each pawl 94 has a complementary profile configuration, while the material of construction enables resilient displacement of each pawl 94 relative to teeth 92 sufficient to allow selective intentional indexing of each tenon 84 within each counterpart slot 80 until a final selected relative position is reached between each tenon 84 and each counterpart slot 80 and, consequently, between the side wall members 60 and 62. The final selected relative position between the side wall members 60 and 62 is reached when the side wall members 60 and 62 are juxtaposed with the package 30, or column 32 of packages 30, in a guiding relationship along path of travel P, rendering it a simple task to assemble apparatus 20 in place, adjusted precisely to the merchandise to be displayed and dispensed, without the need for supplemental tools and measurements in order to attain an appropriate adjustment. The plurality of relatively closely spaced apart teeth 92 and pawls 94 afford a fine adjustment, assuring the attainment of an accurate fit for exemplary operation during display and dispensing of packages 30 selected from packages having a range of different dimensions.

Figure 9:
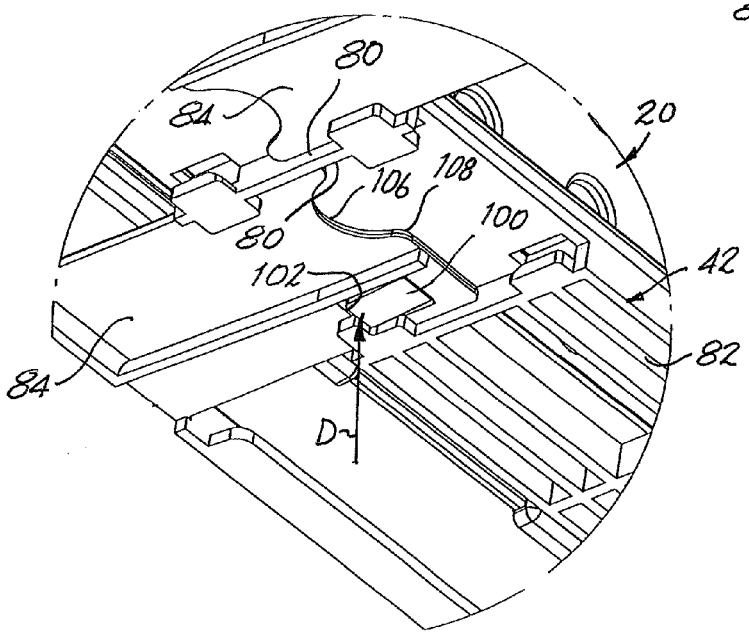
FIG. 9 is an enlarged, fragmentary view of a portion of FIG. 8 indicated by arrow 9 in FIG. 8.
Figure 10:
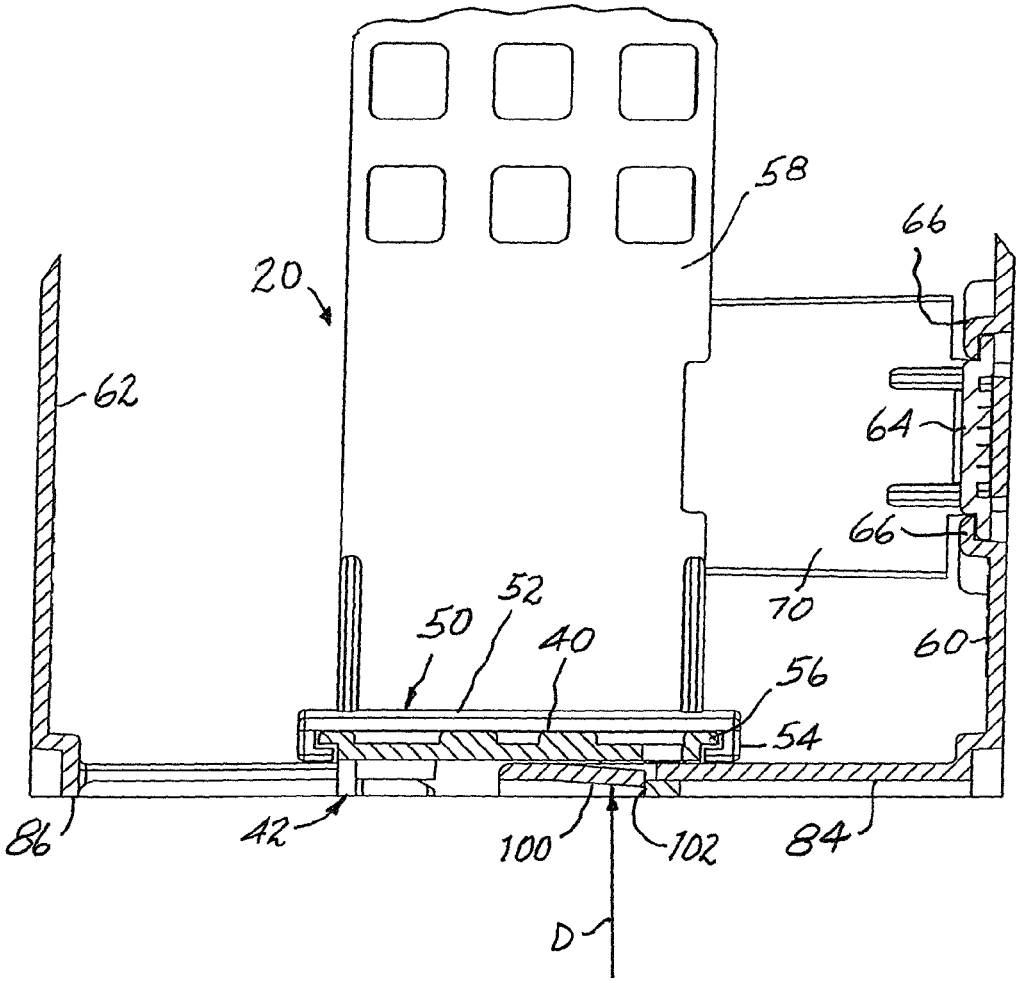
FIG. 10 is an enlarged fragmentary cross-sectional view taken along line 10-10 of FIG. 3.

With reference to FIGS. 8 through 10, it is noted that once side wall members 60 and 62 are assembled with track member 42, as described above, inadvertent disassembly is precluded by a tab 100 located on and depending from each tenon 84, and an abutment shoulder 102 located on the track member 42 in juxtaposition with a corresponding slot 80. Tab 100 is resiliently deflectable so as to pass over abutment shoulder 102 as each tenon 84 is inserted into a counterpart slot 80; however, upon clearing abutment shoulder 102, tab 100 will return to the depending position wherein inadvertent disengagement of a tenon 84 from a counterpart slot 80 is precluded by engagement of the tab 100 with a counterpart abutment shoulder 102. Should it become necessary to disengage a so-retained tenon 84 from a counterpart slot 80, tab 100 may be deflected manually away from engagement with abutment shoulder 102 by pressing tab 100 in the direction of arrow D to allow such disengagement. A recess 106 is provided at the tip 108 of each tenon 84 to accommodate an operator's finger (not shown) so as to facilitate an intentional withdrawal of a tenon 84 from a counterpart slot 80.

Figure 5:
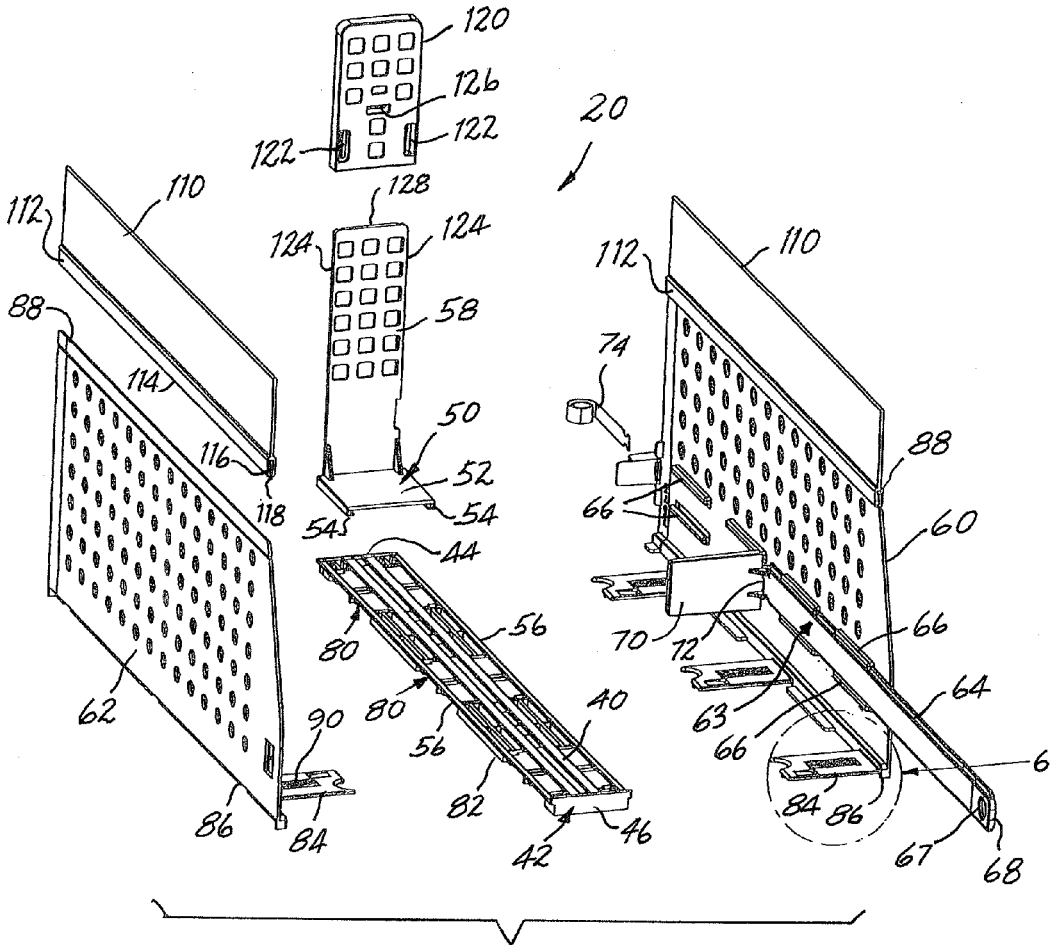
FIG. 5 is a front, top, left side pictorial view, exploded to show component parts of the apparatus and to illustrate the method of the present invention.
Figure 6:
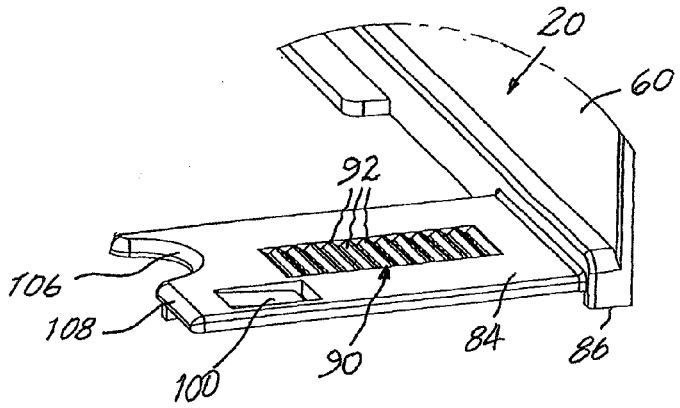
FIG. 6 is an enlarged fragmentary pictorial view of the portion of FIG. 5 indicated by arrow 6 in FIG. 5.

Should packages 30 have an altitudinal dimension that extends the packages 30 altitudinally beyond the upper edge 88 of each side wall member 60 and 62, apparatus 20 may include auxiliary wall members 110 which are selectively attached to corresponding side wall members 60 and 62, as necessary. Each auxiliary wall member 110 includes an integral channel member 112 extending longitudinally along the lower boundary 114 of the auxiliary wall member 110, and each channel member 112 provides a longitudinally-extending groove 116 having an opening 118 with a lateral width so related to the thickness of each side wall member 60 and 62, along upper edge 88 thereof, as to enable a channel member 112 to receive the upper edge 88 of a side wall member 60 or 62, with a gripping force that will secure each auxiliary wall member 110 in place on a corresponding side wall member 60, 62, in a clip-like manner, as seen in FIGS. 1 and 5, thus increasing the altitudinal extent of side wall members 60 and 62 by the height of each auxiliary wall member 110 to accommodate packages of extended height, as shown in phantom at 30H in FIG. 4.

At the same time, an auxiliary paddle 120 may be affixed to paddle 58 to accommodate the taller packages 30H by extending the effective height of paddle 58. Auxiliary paddle 120 includes opposite connectors 122 which are fitted over opposite edges 124 of paddle 58 by sliding downwardly along paddle 58 until a stop element 126 engages the top edge 128 of paddle 58 to secure auxiliary paddle 120 in place in connection with paddle 58.

In the preferred construction, the basic component parts of apparatus 20, as described above, are molded of a synthetic polymeric material having sufficient rigidity, together with a degree of resiliency, to perform the functions set forth above. The individual component parts are configured to be furnished in a highly compact kit of component parts capable of economical packaging and transport, and ready assembly for erection in the field, all as described in detail above.

It will be seen that the present invention attains all of the objects and advantages summarized above, namely: Provides an apparatus which facilitates the display and dispensing of serially arranged merchandise packages at a point-of-purchase, together with ease of erection, installation and selective adjustment to accommodate merchandise packages of any one of a range of different dimensions; enables increased economy and versatility in accommodating the transport of apparatus for dispensing of merchandise at a point-of-purchase site while allowing simplified adjustments during erection of the apparatus at the point-of-purchase site to accommodate the particular dimensions of the merchandise to be dispensed; facilitates the organization of merchandise for display and dispensing at points-of-purchase located along store shelves; provides simplified apparatus constructed economically of fewer component parts; allows compact packaging for economical transport to a selected site and subsequent ease of set-up and use at the site for accommodating a wide variety of merchandise displayed and dispensed at a point-of-purchase; offers less obtrusive and aesthetically more desirable apparatus for the display and dispensing of merchandise packages; affords purchasers with added ease and convenience in selecting merchandise presented at a point-of-purchase; provides a less complex apparatus for the display and dispensing of merchandise at a point-of-purchase, capable of exemplary performance over a relatively long service life.

The embodiments of the invention in which an exclusive property or privilege is claimed are defined as follows:

1. A modular apparatus for displaying and dispensing selected merchandise at a point-of-purchase location placed at a selected site adjacent a display shelf extending in lateral directions at the site, the merchandise being in the form of packages of selected dimensions, including a selected lateral width, arranged serially along a path of travel extending longitudinally toward a forward dispensing location placed at the point-of-purchase, the apparatus facilitating transport to and erection at the site to accommodate the packages of selected dimensions, the apparatus comprising:

a track member having a platform for extending along a longitudinal direction adjacent the path of travel, in juxtaposition with the serially arranged packages, the platform including a near end for placement adjacent the forward dispensing location, a far end spaced longitudinally away from the near end, and laterally opposite sides;

a pusher configured for sliding engagement with the track member, the pusher being selectively movable along the track member in longitudinal directions between the far end and the near end of the track member;

a plurality of slots extending laterally within the track member, altitudinally below the platform and spaced longitudinally from one another along the track member;

a pair of wall members, each wall member having a longitudinal length and extending attitudinally between an upper edge and a lower edge, each wall member having a plurality of tenons projecting laterally from the wall member, adjacent the lower edge of the wall member, and spaced longitudinally from one another along the wall member such that each one of the plurality of tenons will register with a corresponding one of the plurality of slots, each tenon having altitudinal and lateral dimensions complementary to corresponding altitudinal and lateral dimensions of a corresponding slot so that upon registration of each tenon with a corresponding slot, each tenon will extend into engagement with a corresponding slot;

a rack extending in a lateral direction along either one of the slots and the tenons, each rack having a plurality of teeth spaced apart laterally along the rack; and a pawl arrangement projecting from a corresponding one of the slots and the tenons in a direction transverse to the slots and to the tenons in position to engage a corresponding rack in response to insertion of each tenon into a corresponding slot;

the plurality of teeth and each corresponding pawl arrangement having complementary configurations for allowing selective movement of each tenon within a corresponding slot such that upon placement of packages of selected dimensions upon the platform, alignment of each one of the pair of wall members with a corresponding one of the laterally opposite sides of the track member and insertion of each tenon projecting from each wall member within a corresponding slot in the track member, movement of the wall members laterally toward one another will engage each pawl arrangement with a corresponding rack, allowing such movement of the wall members toward one another until the wall members are placed in juxtaposition with the selected lateral width of the packages on the platform, whereupon the engagement of each pawl arrangement with adjacent corresponding teeth of a corresponding rack will secure the wall members in place, in guiding juxtaposition with the serially arranged packages on the platform.

2. The modular apparatus of claim 1 wherein each pawl arrangement includes at least two serially adjacent pawls for capturing one of the teeth of the corresponding rack between the serially adjacent pawls.

3. The modular apparatus of claim 1 wherein each pawl arrangement is located on the track member, and each rack is located on a corresponding tenon.

4. The modular apparatus of claim 3 wherein each pawl arrangement includes at least two serially adjacent pawls for capturing one of the teeth of the corresponding rack between the serially adjacent pawls.

5. The modular apparatus of claim 4 wherein at least one of the track member and the pair of wall members is constructed of a resiliently flexible material.

6. The modular apparatus of claim 1 including a retaining arrangement for precluding inadvertent withdrawal of a tenon from a corresponding slot, subsequent to insertion of the tenon into the corresponding slot.

7. The modular apparatus of claim 6 wherein the retaining arrangement includes a shoulder on either one of the track member and each corresponding tenon, and a tab on a corresponding one of the track member and each corresponding tenon, the shoulder and the tab being located relative to one another such that upon insertion of a tenon into a corresponding slot, a corresponding tab will be flexed from a first position to a second position to ride over a corresponding shoulder, and upon an attempted withdrawal of an inserted tenon from a corresponding slot, the corresponding tab will engage the corresponding shoulder, by virtue of having returned to the first position, to preclude such withdrawal.

8. The modular apparatus of claim 7 wherein each shoulder is located on the track member and each tab is located on a corresponding tenon.

9. The modular apparatus of claim 1 wherein the packages of selected dimensions include a selected altitudinal height, and wherein the apparatus includes:

a pair of wall extensions having a longitudinal length corresponding substantially to the longitudinal length of each wall member, and an altitudinal height extending between an upper boundary and a lower boundary; and a channel extending longitudinally along each lower boundary and having a channel width;

an upper edge portion extending along the longitudinal length of each wall member and having a lateral thickness; and the relative dimensions of the channel width and the lateral thickness of the upper edge portion of each wall member being such that upon insertion of each upper edge portion into a corresponding channel, each corresponding wall extension will extend altitudinally upwardly for placement into guiding juxtaposition with packages of selected altitudinal height placed on the platform of the track member.

10. The modular apparatus of claim 1 including a puller member mounted upon one of the pair of wall members for sliding movement in longitudinal directions between a retracted position and an advanced position, the puller member having:

a rearward end and a forward end;

an arm carried by the puller member adjacent the rearward end and extending laterally for placement behind the pusher member; and a finger-grip adjacent the forward end for placement adjacent the forward dispensing location when the puller member is in the retracted position such that upon a purchaser grasping the finger-grip and drawing the puller member toward the advanced position, the arm will engage the pusher member to move the pusher member, together with the serially arranged packages, along the platform to the dispensing location.

11. The modular apparatus of claim 10 including a resiliently biased retraction mechanism coupled with the puller member for permitting advancement of the puller member into the advanced position and resiliently biasing the puller member into the retracted position.

12. A method for erecting a modular apparatus for displaying and dispensing selected merchandise at a point-of-purchase location placed at a selected site adjacent a display shelf extending in lateral directions at the site, the merchandise being in the form of packages of selected dimensions, including a selected lateral width, arranged serially along a path of travel extending longitudinally toward a forward dispensing location placed at the point-of-purchase, the apparatus facilitating transport to and erection at the site to accommodate the packages of selected dimensions, the method comprising:

placing at the site, a track member having a platform for extending along a longitudinal direction adjacent the path of travel, in juxtaposition with the serially arranged packages, the platform including a near end for placement adjacent the forward dispensing location, a far end spaced longitudinally away from the near end, and laterally opposite sides;

engaging a pusher with the track member, the pusher being configured for sliding engagement with the track member, selectively movable along the track member in longitudinal directions between the far end and the near end of the track member;

providing a plurality of slots extending laterally within the track member, altitudinally below the platform and spaced longitudinally from one another along the track member;

providing a pair of wall members, each wall member having a longitudinal length and extending altitudinally between an upper edge and a lower edge, each wall member having a plurality of tenons projecting laterally from the wall member, adjacent the lower edge of the wall member, and spaced longitudinally from one another along the wall member;

registering each one of the plurality of tenons with a corresponding one of the plurality of slots, each tenon being provided with altitudinal and lateral dimensions complementary to corresponding altitudinal and lateral dimensions of each corresponding slot so that upon registration of each tenon with a corresponding slot, each tenon will extend into engagement with a corresponding slot;

providing a rack extending in a lateral direction along either one of the slots and the tenons, each rack having a plurality of teeth spaced apart laterally along the rack; and providing a pawl arrangement projecting from a corresponding one of the slots and the tenons in a direction transverse to the slots and to the tenons in position to engage a corresponding rack in response to insertion of each tenon into a corresponding slot;

providing the plurality of teeth and each corresponding pawl arrangement with complementary allowing selective movement of each tenon within a corresponding slot;

placing packages of selected dimensions upon the platform;

aligning each one of the pair of wall members with a corresponding one of the laterally opposite sides of the track member and inserting each tenon projecting from each wall member into a corresponding slot in the track member;

moving the wall members laterally toward one another to engage each pawl arrangement with a corresponding rack; and continuing such movement of the wall members toward one another, as allowed by the complementary configurations of the plurality of teeth of each rack and each corresponding pawl arrangement, until the wall members are placed in juxtaposition with the selected lateral width of the packages on the platform, whereupon the engagement of each pawl arrangement with adjacent corresponding teeth of a corresponding rack will secure the wall members in place, in guiding juxtaposition with the serially arranged packages on the platform, to complete the erection of the apparatus.

13. A kit of component parts for erecting a modular apparatus at a selected site for displaying and dispensing selected merchandise at a point-of-purchase location placed at the selected site adjacent a display shelf extending in lateral directions at the site, the merchandise being in the form of packages of selected dimensions, including a selected lateral width, to be arranged serially along a path of travel extending longitudinally toward a forward dispensing location placed at the point-of-purchase, the kit facilitating transport to and erection at the site to accommodate the packages of selected dimensions, the kit comprising:

a track member having a platform extending along a longitudinal direction to be aligned with the path of travel, in juxtaposition with the serially arranged packages, the platform including a near end for placement adjacent the forward dispensing location, a far end spaced longitudinally away from the near end, and laterally opposite sides;

a pusher configured for sliding engagement with the track member, to enable the pusher to be selectively movable along the track member in longitudinal directions between the far end and the near end of the track member;

a plurality of slots extending laterally within the track member, altitudinally below the platform and spaced longitudinally from one another along the track member;

a pair of wall members, each wall member having a longitudinal length and extending altitudinally between an upper edge and a lower edge, each wall member having a plurality of tenons projecting laterally from the wall member, adjacent the lower edge of the wall member, and spaced longitudinally from one another along the wall member for enabling the plurality of tenons to be registered with a corresponding plurality of slots, each tenon having altitudinal and lateral dimensions complementary to corresponding altitudinal and lateral dimensions of a corresponding slot so that upon registration of each tenon with a corresponding slot, each tenon will be able to extend into engagement with a corresponding slot;

a rack extending in a lateral direction along either one of the slots and the tenons, each rack having a plurality of teeth spaced apart laterally along the rack; and a pawl arrangement projecting from a corresponding one of the slots and the tenons in a direction transverse to the slots and to the tenons in position to enable engagement with a corresponding rack in response to insertion of each tenon into a corresponding slot;

the plurality of teeth and each corresponding pawl arrangement having complementary configurations for allowing selective movement of each tenon within a corresponding slot such that upon placement of packages of selected dimensions upon the platform, alignment of each one of the pair of wall members with a corresponding one of the laterally opposite sides of the track member and insertion of each tenon projecting from each wall member within a corresponding slot in the track member, movement of the wall members laterally toward one another will enable engagement of each pawl arrangement with a corresponding rack, allowing such movement of the wall members toward one another until the wall members are placed in juxtaposition with the selected lateral width of the packages on the platform, whereupon the engagement of each pawl arrangement with adjacent corresponding teeth of a corresponding rack will accomplish securement of the wall members in place, in guiding juxtaposition with the serially arranged packages on the platform.

14. The kit of component parts of claim 13 wherein each pawl arrangement includes at least two serially adjacent pawls for capturing one of the teeth of the corresponding rack between the serially adjacent pawls.

15. The kit of component parts of claim 13 wherein each pawl arrangement is located on the track member, and each rack is located on a corresponding tenon.

16. The kit of component parts of claim 15 wherein each pawl arrangement includes at least two serially adjacent pawls for capturing one of the teeth of the corresponding rack between the serially adjacent pawls.

17. The kit of component parts of claim 16 wherein at least one of the track member and the pair of wall members is constructed of a resiliently flexible material.

18. The kit of component parts of claim 13 including a retaining arrangement for precluding inadvertent withdrawal of a tenon from a corresponding slot, subsequent to insertion of the tenon into the corresponding slot.

19. The kit of component parts of claim 18 wherein the retaining arrangement includes a shoulder on either one of the track member and each corresponding tenon, and a tab on a corresponding one of the track member and each corresponding tenon, the shoulder and the tab being located relative to one another such that upon insertion of a tenon into a corresponding slot, a corresponding tab will be flexed from a first position to a second position to ride over a corresponding shoulder, and upon an attempted withdrawal of an inserted tenon from a corresponding slot, the corresponding tab will engage the corresponding shoulder, by virtue of having returned to the first position, to preclude such withdrawal.

20. The kit of component parts of claim 19 wherein each shoulder is located on the track member and each tab is located on a corresponding tenon.

21. The kit of component parts of claim 13 wherein the packages of selected dimensions include a selected altitudinal height, and wherein the kit includes:

a pair of wall extensions having a longitudinal length corresponding substantially to the longitudinal length of each wall member, and an altitudinal height extending between an upper boundary and a lower boundary; and a channel extending longitudinally along each lower boundary and having a channel width;

an upper edge portion extending along the longitudinal length of each wall member and having a lateral thickness; and the relative dimensions of the channel width and the lateral thickness of the upper edge portion of each wall member being such that upon insertion of each upper edge portion into a corresponding channel, each corresponding wall extension will extend altitudinally upwardly for placement into guiding juxtaposition with packages of selected altitudinal height placed on the platform of the track member.

* * * * *